US006776637B2

(12) United States Patent
Yamada et al.

(10) Patent No.: US 6,776,637 B2
(45) Date of Patent: Aug. 17, 2004

(54) PANEL MOUNTED ELECTRICAL CONNECTOR MOVABLE RELATIVE TO THE PANEL

(75) Inventors: Akio Yamada, Tokyo (JP); Kazuyuki Ozai, Tokyo (JP); Hitoshi Kikuchi, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 10/202,371

(22) Filed: Jul. 24, 2002

(65) Prior Publication Data

US 2003/0171029 A1 Sep. 11, 2003

(30) Foreign Application Priority Data

Mar. 5, 2002 (JP) ..... 2002-058345

(51) Int. Cl.[7] ..... H01R 4/38
(52) U.S. Cl. ..... 439/247; 439/248
(58) Field of Search ..... 439/247, 248, 439/246, 572

(56) References Cited

U.S. PATENT DOCUMENTS 6,017,233 A * 1/2000 Fry et al. ..... 439/248
6,450,840 B2 * 9/2002 Nakamura ..... 439/752
2001/0027039 A1 * 10/2001 Okabe et al. ..... 439/79

* cited by examiner

*Primary Examiner*—Chandrika Prasad
(74) *Attorney, Agent, or Firm*—Baker Botts L.L.P.

(57) ABSTRACT

An electrical connector adapted to be mounted onto a panel of an electronic appliance includes a housing and a predetermined number of contacts held and fixed in the housing. The housing includes one or more projections formed on each of an upper surface and a lower surface of the housing, and the projections are adapted to be positioned on a first side of the panel. The electrical connector also includes a block which engages the housing, and the block is adapted to be positioned on a second side of the panel which is opposite the first side of the panel. Moreover, the block includes a through-hole formed therethrough. The electrical connector also includes a fixing pin, and a portion of the fixing pin is positioned within the through-hole.

8 Claims, 3 Drawing Sheets

PANEL MOUNTED ELECTRICAL CONNECTOR MOVABLE RELATIVE TO THE PANEL

BACKGROUND OF THE INVENTION

This invention relates to an electrical connector for use in electric and electronic appliances, servers and the like, and more particularly to an electrical connector which can be easily mounted on a panel, particularly, in a floating manner.

A hitherto used electrical connector will be explained. FIG. 4 illustrates a prior art electrical connector in a perspective view. The electrical connector 50 includes a housing 52, a required number of contacts held and fixed to the housing 52, and set screws 70 and nuts 74 for fixing the housing 52 to a panel 64. The housing 52 is provided at its lengthwise ends with flange portions 56 each of which is formed with a through-hole 58 through which the set screw 70 passes.

In order to mount the electrical connector 50 onto the panel 64, after the fitting portion of the housing 52 has been fitted in a fitting opening 66 of the panel 64, the set screws 70 are inserted from the extending side of the fitting portion of the housing 52 into engaging apertures 68 of the panel 64 and the through-holes 58 of the flange portions 56, and the nuts 74 are then threadedly engaged and tightened onto distal ends of the set screws 70 extending from the through-holes 58 on their rear side. Each of the set screws 70 includes a positioning portion 72 having a diameter smaller than the inner diameter of the engaging aperture 68 of the panel 64. A floating mounting of the electrical connector on the panel 64 is accomplished by clearances between the engaging apertures 68 of the panel 64 and the positioning portions 72 of the set screws 70.

With the above construction of the connector of the prior art, the set screws passing through the panel and electrical connector must be threadedly engaged with the nuts and tightened thereby during holding the electrical connector to the panel. Such an operation would be troublesome and time-consuming.

In order to mount the electrical connector onto the panel, moreover, at least two set screws and two nuts are required to increase the number of parts, causing their management cost and hence manufacturing cost to increase.

With this electrical connector of the prior art, furthermore, the engaging apertures 68 of the panel 64 are circular, while the set screws 70 have the cross-sectionally circular positioning portion 72 so that the floating amounts (clearances) are substantially the same in directions X and Y shown in FIG. 4. Consequently, it is impossible to adjust the floating amount in one direction according to a specification of an appliance.

SUMMARY OF THE INVENTION

It is an object of the invention to provide an improved electrical connector which is able to be easily and simply mounted onto a panel without increasing its manufacturing cost to eliminate all the disadvantages of the prior art described above.

In order to achieve this object, in an electrical connector including a housing and a required number of contacts held and fixed in the housing, according to the invention the housing comprises at least one projection on each of surfaces defining its thickness, a block formed integrally with or separately from the housing and formed with a through-hole in its one flange portion, and a fixing pin to be inserted into the through-hole of the block for mounting the electrical connector onto a panel in a floating manner.

In a preferred embodiment of the invention, the fixing pin is in the form of a plate-shaped piece and the through-hole has a substantially rectangular cross-section, and one projection is provided inside the through-hole and two notches are provided in the fixing pin. In this manner, the electrical connector can be mounted onto the panel to adjust the floating amount in one direction depending upon the specification of an appliance using the electrical connector.

Preferably, a pair of projections are provided inside the through-hole and two pairs of notches are provided in both lengthwise edges of the fixing pin. In this manner, the fixing pin can be stably fitted in the through-hole with a great certainty.

In another preferable embodiment of the invention, the notch (notches) near the forward end of the fixing pin engages the projection (projections) in the through-hole prior to the mounting of the electrical connector onto the panel, and the forward end of the fixing pin is in a fitting opening of the panel and the notch (notches) remote from the forward end of the fixing pin engages the projection (projections) in the through-hole after the electrical connector has been mounted on the panel, thereby preventing the fixing pin from removing from the through-hole.

Preferably, the block is larger than the housing to produce a surface of the block resulting from the largeness, thereby mounting the electrical connector on the panel with the at least one projection on each of the surfaces of the housing and the surface abutting against a surface of the panel. The panel is embraced between the projections and the surface of the block abutting against the panel to facilitate the mounting of the electrical connector on the panel.

The housing is provided at its both lengthwise ends with guide means for positioning the electrical connector relative to a mating connector. With this arrangement, the electrical connector can be connected to a mating connector in a reliable manner even if the electrical connector is mounted on the panel in a floating manner.

In a further embodiment of the invention, after the projections of the housing have been fitted in a fitting opening of the panel, the housing is moved into a direction opposite to the side of the through-hole, and thereafter the fixing pin is inserted into the through-hole so that the forward end of the fixing pin enters the fitting opening, thereby mounting the electrical connector on the panel in the floating manner with the aid of clearances between the fixing pin and the fitting opening of the panel.

After the housing has been inserted in the fitting opening of the panel, the housing is moved along the panel in the direction opposite to the side of the through-hole (in the direction C in FIG. 1), thereby embracing the panel between the protrusions and the surface of the block produced by the largeness of the block.

Before mounting the electrical connector on the panel, the notch (notches) near the forward end of the fixing pin engages the projection (projections) in the through-hole, and after the electrical connector has been mounted on the panel, the forward end of the fixing pin is in the fitting opening of the panel and the notch (notches) remote from the forward end of the fixing pin engages the projection (projections) in the through-hole to prevent the fixing pin from removing from the through-hole, thereby preventing the electrical connector from moving away from the panel.

The electrical connector having the subject features of the invention can bring about the following significant effects.

(1) According to the invention, the electrical connector can be easily mounted onto a panel only by inserting the fixing pin into the through-hole of the block of the electrical connector and can be supported on the panel in a floating manner with clearances between the fixing pin and a fitting opening of the panel.

(2) According to the invention, audible and/or tactile clicks are produced when the fixing pin is inserted into the through-hole so that an operator can ascertain whether the fixing pin has been reliably fixed in the through-hole.

(3) According to the invention, the electrical connector can be fixed to a panel only by one fixing pin so that the number of parts are reduced to cut down the costs such as manufacturing cost, management cost and the like in comparison with the prior art.

(4) According to the invention, the electrical connector can be easily and simply mounted on a panel only by pushing the fixing pin in one direction without holding the electrical connector and set screws and nuts which would otherwise be required.

(5) According to the invention, the fixing pin is a substantially plate-shaped piece and formed with at least one notch, and the through-hole for receiving the fixing pin has a rectangular cross-section and provided therein with at least one projection. Therefore, the electrical connector can be easily mounted on a panel so as to permit the floating amount of the connector to be adjusted relative to the panel in one direction depending upon a specification of an appliance using the connector.

The invention will be more fully understood by referring to the following detailed specification and claims taken in connection with the appended drawings.

DESCRIPTION OF THE PREFERRED EMBODIMENTS

Figure 1:
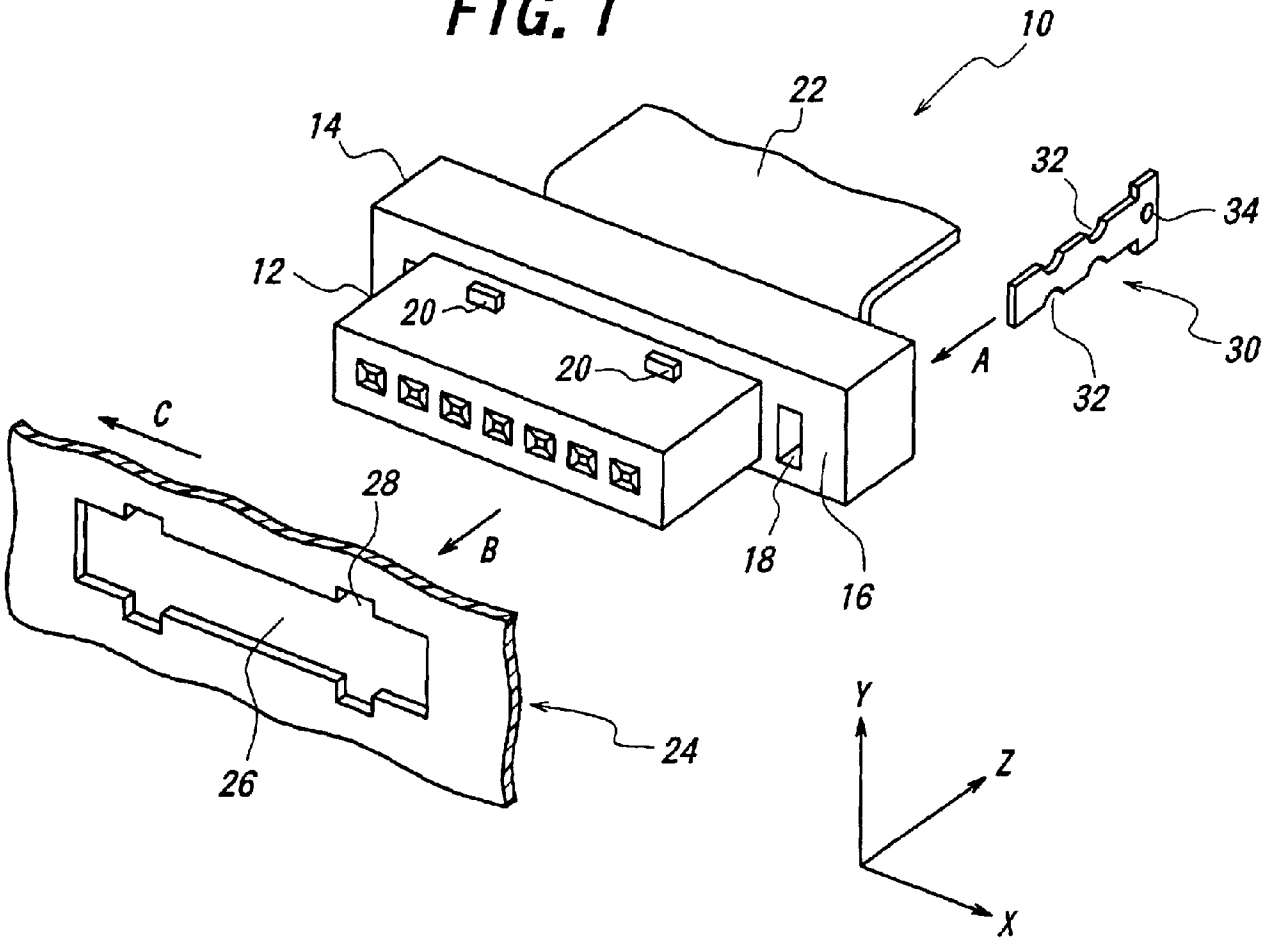
FIG. 1 is a partly perspective view of the electrical connector according to the invention showing a fixing pin and part of a panel.
Figure 2A:
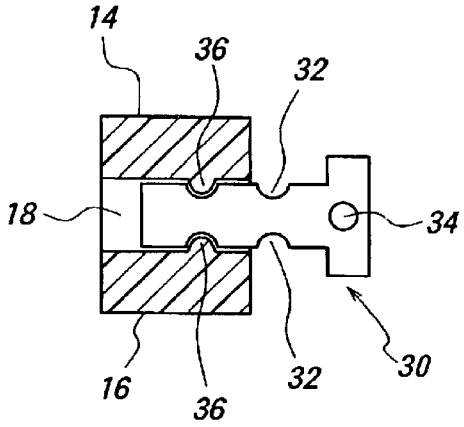
FIG. 2A is a sectional view illustrating the fixing pin temporarily fixed to the housing shown in FIG. 1.
Figure 2B:
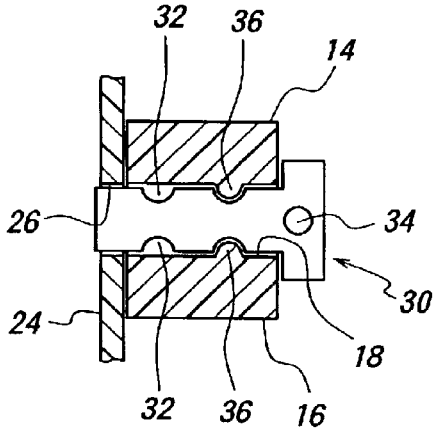
FIG. 2B is a sectional view illustrating the housing in the state of the electrical connector according to the invention fixed to a panel.
Figure 3:
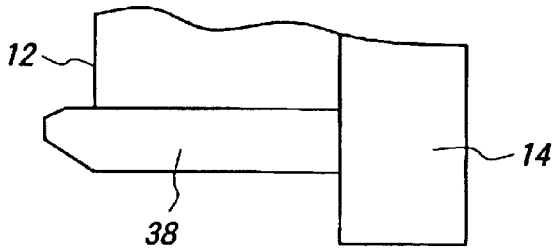
FIG. 3 is an explanatory view of guide means for guiding the electrical connector to a mating connector.
Figure 4:
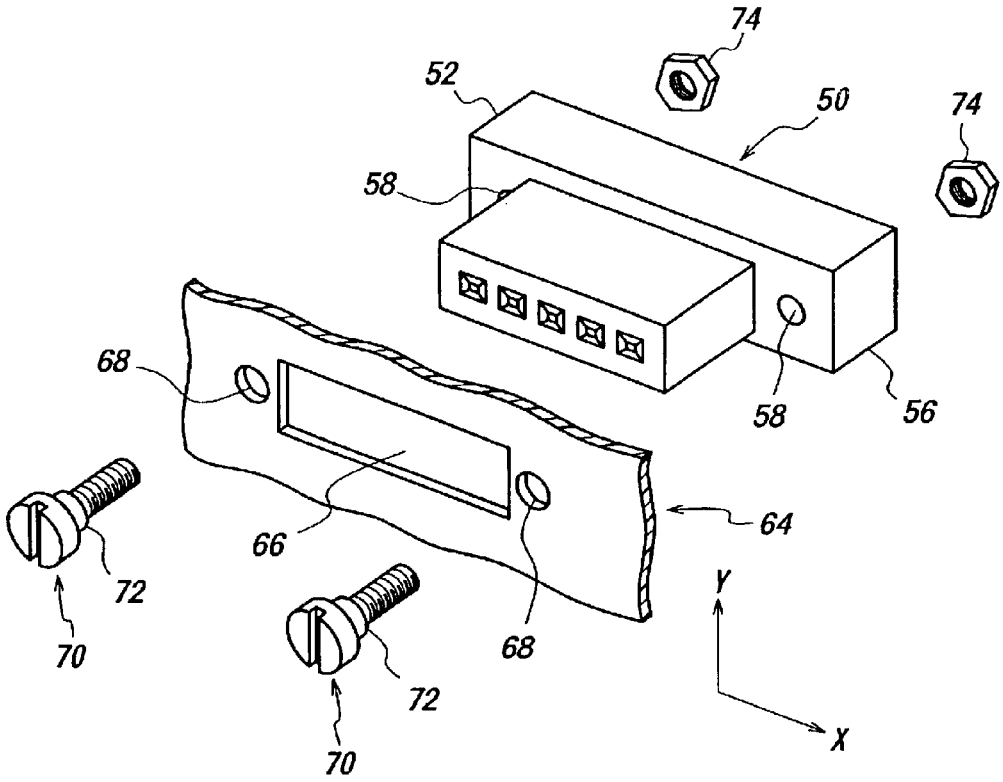
FIG. 4 PRIOR ART
FIG. 4 is a perspective view of an electrical connector of the prior art.

An electrical connector according to the invention will be explained hereinafter with reference to the drawings. FIG. 1 illustrates in a perspective view the electrical connector according to the invention with a fixing pin and part of a panel. FIGS. 2A and 2B show in section the fixing pin temporarily fixed in a housing, and the electrical connector fixed to the panel by means of the fixing pin, respectively. FIG. 3 explanatorily illustrates guide means for guiding the connector to a mating connector. The electrical connector 10 according to the invention mainly comprises the housing 12, contacts and the fixing pin 30.

First, the fixing pin 30 will be explained which is a subject feature of the invention. The fixing pin 30 is made of a metal by means of press-working in the conventional manner. Preferred metals for the fixing pin 30 are brass, phosphor bronze, steel and the like in consideration of high strength, durability and the like.

As shown in FIG. 1, the fixing pin 30 is a substantially T-shaped plate and has two recesses or notches 32 on either side. These notches 32 of the fixing pin 30 are adapted to engage projections 36 provided in a through-hole 18 of the housing 12 or block 14 to provide a click engagement therebetween, thereby preventing the fixing pin 30 from disengaging from the housing 12 or block 14 in usual handling. As described above, in the moment when the fixing pin 30 is inserted in the through-hole 18, audible or tactile clicks are produced, whereby an operator can ascertain whether the fixing pin has been fixed in the through-hole 18.

The four recesses or notches 32 of the fixing pin 30 are arranged in symmetry with respect to a center line of the T-shaped fixing pin 30 to form two pairs of the notches 32. The pair of notches 32 near the forward end of the fixing pin 30 are for temporarily fixing the pin 30 to the housing 12 or block 14 as shown in FIG. 2A, while the remaining pair of notches 32 serve to fix the pin 30 to the housing 12 or block 14 ultimately and to mount the electrical connector on a panel 24 when the forward end of the fixing pin 30 is inserted into a fitting opening 26 of the panel 24 as shown in FIG. 2B. In view of these functions of the notches 32, the positional relation between the notches 32 is suitably determined in a manner such that when the pair of notches 32 remote from the forward end of the pin 30 engage the projections 36 in the through-hole 18 of the housing 12 or block 14, the forward end of the pin 30 is surely in the fitting opening 26 of the panel 24.

While the hemi-circular recesses or notches 32 of the fixing pin 30 are shown in the illustrated embodiment, it will be apparent that any shapes of the notches 32 may be provided so long as they can perform the above functions, such as triangular, rectangular, elliptical shapes and the like. Moreover, any sizes of the notches 32 may be employed so long as they fulfil the requirement imposed thereon. In determining the size of the notches 32 of the pin 30, the strength and holding force of the fixing pin 30 may be considered.

Hereinafter, the suitable size of the fixing pin 30 will be explained. The definition of length of the fixing pin 30 means length along the axis Z shown in FIG. 1. Whereas, width and thickness of the same mean the dimensions along Y and X, respectively shown in the drawing. These definitions are equally applied throughout the text. The length of the fixing pin 30 may be suitably determined in consideration of the above its functions. The width and thickness of the fixing pin 30 may be suitably designed such that the electrical connector is supported in a floating manner by the panel owing to clearances between the fixing pin 30 and the fitting opening 26 of the panel 24. The rearward end of the fixing pin 30 opposite to the forward end extends outwardly in its width directions to form the head portion of the "T" shape so as to form shoulders which abut against the surface of the housing 12 or block 14 to determine the ultimate position of the fixing pin 30. Moreover, the head portion of the fixing pin 30 is formed with a through-aperture 34 to facilitate the removal of the fixing pin 30 from the through-hole 18 of the housing 12 or block 14.

The forward end of the fixing pin 30 may be chamfered or rounded in order to facilitate the insertion of the forward end of the pin 30 into the through-hole 18 of the housing 12 or block 14 and the fitting opening 26 of the panel 24.

The housing 12 will be explained hereinafter, which is another subject feature of invention. The housing 12 is injection molded from an electrically insulating plastic material in the conventional manner. Preferred materials from which to form the housing 12 include polybutylene terephthalate (PBT), polyamide (66PS or 46PA), liquid crystal polymer (LCP), polycarbonate (PC) and the like and combinations thereof in view of the requirements imposed on such a housing 12 with respect to dimensional stability, workability, manufacturing cost and the like.

The housing 12 is formed with a required number of contact insertion apertures for holding and fixing contacts therein and provided with a block 14 which is integrally with or separately from the housing 12. The block 14 is substantially larger than the housing 12 as shown in FIG. 1. The block 14 is provided at one end with a flange 16 formed with the through-hole 18 into which the fixing pin 30 is inserted. Provided in place inside the through-hole 18 are the pair of projections 36 adapted to engage the notches or recesses 32 of the fixing pin 30.

The position and size of the projections 36 may be so determined that when the notches 32 of the fixing pin 30 remote from its forward end are engaged with the projections 36, the forward end of the fixing pin 30 is just in the fitting opening 26 of the panel 24, thereby securely holding the fixing pin 30. The position of the through-hole 18 may be in any location in the flange 16 insofar as the through-hole 18 does not detract from the strength of the flange 16. However, it is preferable to position the through-hole 18 such that the extending portion of the fixing pin 30 from the through-hole 18 extends along the housing 12 as near as possible in view of the tendency of miniaturization of connectors and deformation of fixing pin 30.

The housing 12 is provided with at least one protrusion 20 on each of two surfaces defining its thickness at locations corresponding to engaging apertures or notches 28 along edges of the fitting opening 26 of the panel 24 and having a size permitting the protrusions 20 to be received in the apertures or notches 28. In the illustrated embodiment, two protrusions 20 are provided on each of the upper and lower surfaces of the housing 12 as viewed in FIG. 1. Preferably, the spacing between the two protrusions 20 on one surface is made different from that between the two protrusions 20 on another surface to prevent mixing up the top and bottom of the connector 10 relative to the panel 24. As an alternative, the protrusions 20 on one surface may be varied in size from the protrusions 20 on another surface to prevent the mixing up of the top and bottom of the connector 10. The positions of the protrusions 20 are suitably designed in consideration of the thickness of the panel 24 such that the panel 24 is embraced between the block 14 and the protrusions 20.

As shown in FIG. 3, the housing 12 is provided at its both lengthwise ends with guide means 38 for positioning the electrical connector 10 relative to a mating connector. Forward ends of the guiding means may be preferably chamfered, tapered or rounded to facilitate approaching to the mating connector.

A block 14 formed separately from the housing will be explained. The block 14 is injection molded from an electrically insulating plastic material in the conventional manner. Preferred materials from which to form the block 14 include polybutylene terephthalate (PBT), polyamide (66PS or 46PA), liquid crystal polymer (LCP), polycarbonate (PC) and the like and combinations thereof in view of the requirements imposed on such a block 14 with respect to dimensional stability, workability, manufacturing cost and the like.

The block 14 formed separately from the housing is fixed to the housing by means of press-fitting, hooking or the like. Concerning the size of the block 14 and provision of the through-hole 18 in the flange 16, the block 14 is substantially the same as the block formed integrally with the housing 12.

Contacts will then be explained. The contacts are made of a metal and formed by the press-working in the conventional manner. Preferred materials from which to form the contacts include brass, beryllium copper, phosphor bronze and the like to filful the requirement imposed thereon, springiness and the like. Each of the contacts mainly comprises a contact portion adapted to contact a mating contact, a fixed portion to be fixed to the housing 12, and a connection portion to be connected to a cable 22, a circuit board or substrate or the like.

Finally, a method for mounting the electrical connector 10 onto the panel 24 will be explained.

First, the fixing pin 30 is inserted into the through-hole 18 of the electrical connector 10 in a direction shown by an arrow A in FIG. 1 so that the notches 32 of the fixing pin 30 near to its forward end are brought into engagement with the projections 36 inside the through-hole 18. This is the state that the fixing pin 30 is temporarily fitted in the electrical connector 10.

Then, the housing 12 of the electrical connector 10 is aligned with the panel 24 to bring the protrusions 20 of the housing 12 into alignment with the notches 28 of the panel 24. Thereafter, the housing 12 is inserted in a direction shown by an arrow B in FIG. 1 into the fitting opening 26 of the panel 24 until the block 14 abuts against the panel 24.

Thereafter, the electrical connector 10 is moved relative to the panel 24 in a direction shown by an arrow C so that the housing 12 is held by the panel 24 through the protrusions 20 and the block 14 to prevent the electrical connector 10 from being moved relative to the panel 24 in the direction opposite to the direction shown by the arrow B.

Finally, the fixing pin 30 is further inserted into the through-hole 18 in the direction A shown in FIG. 1 until the notches 32 of the fixing pin 30 remote from its forward end are brought into engagement with the projections 36 inside the through-hole 18 and the forward end of the fixing pin 30 is brought into the fitting opening 26, thereby mounting the electrical connector 10 on the panel 24.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrical connector adapted to be mounted onto a panel having a housing opening and a plurality of projection openings formed therethrough, wherein the electrical connector comprises:

a housing comprising at least one projection formed on each of an upper surface and a lower surface of the housing, wherein the at least one projection is formed on the housing, such that the at least one projection is adapted for:

a first movement in a first direction to insert the at least one projection through a corresponding one of the plurality of projection openings and to position the at least one projection on a first side of the panel; and a second movement in a second direction to offset the at least one projection from the corresponding one of the plurality of projection openings, such that the at least one projection engages the panel, wherein the second direction is perpendicular to the first direction;

a predetermined number of contacts held and fixed in the housing;

a block which engages the housing, wherein the block is positioned on a second side of the panel opposite the first side of the panel, and wherein the block comprises a through-hole formed therethrough; and a fixing pin, wherein at least one portion of the fixing pin is positioned within the through-hole.

2. The electrical connector as set forth in claim 1 wherein said fixing pin is in the form of a plate-shaped piece and said through-hole has a substantially rectangular cross-section, and wherein one projection is provided inside said through-hole and two notches are provided in said fixing pin.

3. The electrical connector as set forth in claim 2 wherein a pair of projections are provided inside said through-hole and two pairs of notches are provided in top and bottom edges of said fixing pin.

4. The electrical connector as set forth in claim 3 wherein the notch (notches) near the forward end of said fixing pin engages the projection (projections) in said through-hole prior to the mounting of the electrical connector onto the panel, and the forward end of said fixing pin is in a fitting opening of the panel and the notch (notches) remote from the forward end of said fixing pin engages the projection (projections) in said through-hole after the electrical connector has been mounted on the panel, thereby preventing said fixing pin from removing from said through-hole.

5. The electrical connector as set forth in claim 1 wherein said block is larger than said housing to produce a surface of said block resulting from the largeness, thereby mounting the electrical connector on the panel with said at least one projection on each of the surfaces of the housing and said surface of the block abutting against a surface of said panel.

6. The electrical connector as set forth in claim 1 wherein said housing is provided at its both lengthwise ends with guide means for positioning the electrical connector relative to a mating connector.

7. The electrical connector as set forth in claim 1 wherein said fixing pin is inserted into said through-hole so that the forward end of said fixing pin enters said fitting opening, thereby mounting the electrical connector on the panel in the floating manner with the aid of clearances between said fixing pin and said fitting opening of the panel.

8. The electrical connector as set forth in claim 3 wherein the notches near the forward end of said fixing pin engages the projections in said through-hole prior to the mounting of the electrical connector onto the panel, and the forward end of said fixing pin is in a fitting opening of the panel and the notches remote from the forward end of said fixing pin engages the projections in said through-hole after the electrical connector has been mounted on the panel, thereby preventing said fixing pin from removing said through-hole.

* * * * *